United States Patent [19]

Fujikawa

[11] Patent Number: 4,469,038

[45] Date of Patent: Sep. 4, 1984

[54] SYSTEM FOR CONTROLLING A SEWING MACHINE

[75] Inventor: Katsuhiro Fujikawa, Aichi, Japan

[73] Assignee: Mitsubishi Denki Kabushiki Kaisha, Tokyo, Japan

[21] Appl. No.: 445,614

[22] Filed: Nov. 30, 1982

[30] Foreign Application Priority Data

Nov. 30, 1981 [JP] Japan ..... 56-192341

[51] Int. Cl.[3] ..... D05B 69/22

[52] U.S. Cl. ..... 112/277; 112/121.11

[58] Field of Search ..... 112/275, 277, 121.11, 112/121.12, 158 E, 300

[56] References Cited

U.S. PATENT DOCUMENTS 4,150,634 4/1979 Brown et al. ..... 112/275
4,173,193 11/1979 Morinaga et al. ..... 112/275
4,301,753 11/1981 Meier ..... 112/121.11

OTHER PUBLICATIONS

Martin, "Practical Applications of Voice Input to Machines"; *Proceedings of the IEEE,* Apr. 1976, pp. 487–500.

Chiba, "Voice Recognition Device for Non-Particular Speakers, SR-1000 Series"; Electronic Science, Sep. 1980.

Sekiya, "Voice Data Entry System"; *Electronic Science,* Sep. 1980.

*Primary Examiner*—Peter P. Nerbun

*Attorney, Agent, or Firm*—Sughrue, Mion, Zinn, Macpeak & Seas

[57] ABSTRACT

A system for controlling a sewing machine includes a drive unit including a motor for driving the sewing machine, a brake unit including a brake for stopping the sewing machine, detection means for detecting operational states of the sewing machine, and input means for supplying operation commands to the sewing machine. The input means converts a plurality of sounds voiced by the operator into predetermined speech signals and issues such signals to a control unit to enable the latter to produce operation command signals corresponding to the speech signals for controlling the drive unit and the brake unit.

14 Claims, 2 Drawing Figures

SYSTEM FOR CONTROLLING A SEWING MACHINE

BACKGROUND OF THE INVENTION

The present invention relates to a control system for controlling the operations of a sewing machine.

Conventional apparatuses for controlling sewing machines are provided with a switch-operated input unit including a switch ganged with a treadle. When the switch-operated input unit is operated by the operator, operation commands selected by the operator are transmitted to a motor for driving the sewing machine to control the rotation, de-energization and the RPM of the motor and also various modes of operation of the sewing machine.

Modern sewing machines have a wide variety of functions which are performed by complex, diversified modes of operation. Operation commands which the operator uses to select such modes of the sewing machine are quite large in number, resulting in an increased number of switches installed on the input unit. The switch-operated unit is relatively large in size. All of the switches are hand- and foot-operated, and the operator is required to effect a control operation which is complicated and prone to errors as there are many such switches.

SUMMARY OF THE INVENTION

With the foregoing prior difficulties in view, it is an object of the present invention to provide a sewing machine control system having a relatively small number of control switches and capable of issuing an increased number of complicated operation commands through a simple control operation.

The above object can be achieved by providing an input means for generating operation commands for the sewing machine, the input means comprising a speech recognition means for generating predetermined command signals in response to predetermined voiced inputs, respectively.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Figure 1:
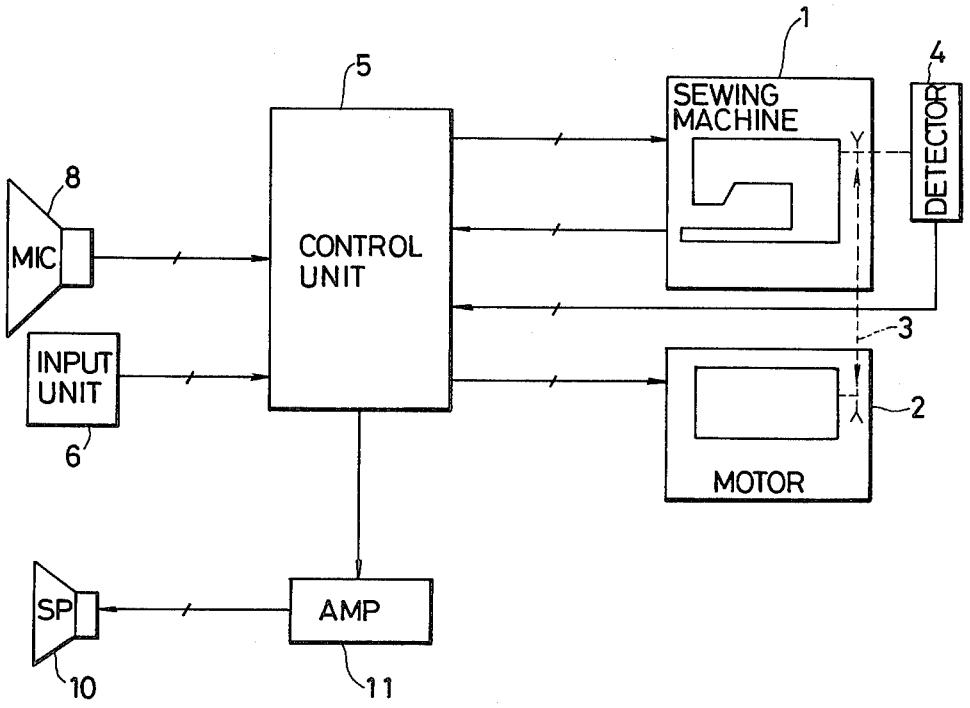
FIG. 1 is a block diagram of a system of controlling a sewing machine according to the present invention.

As shown in FIG. 1, a sewing machine 1 is drivable by a variable-speed motor 2, which is known as a "clutch motor," through a belt 3. The sewing machine 1 can be driven or stopped in response to rotation or stoppage of the motor 2.

Figure 2:
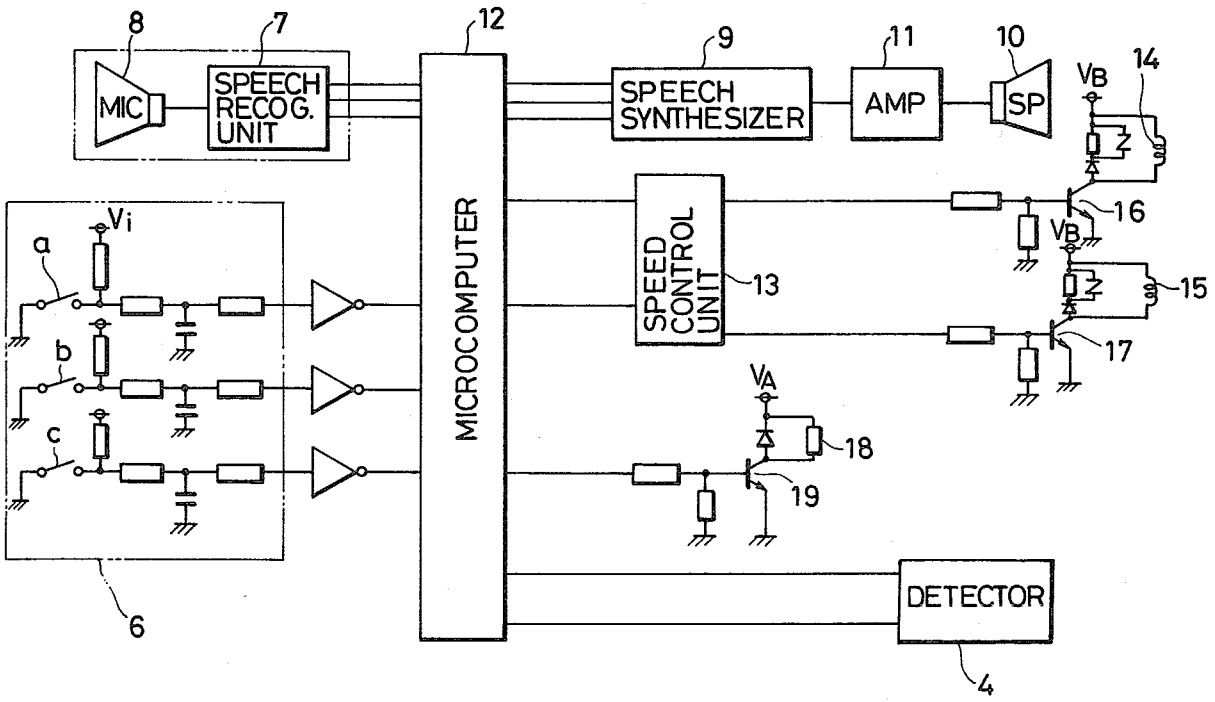
FIG. 2 is a circuit diagram, partly in block form, of a major portion of the system of the invention illustrated in FIG. 1.

A detector 4 is attached to the sewing machine 1 for detecting upper and lower positions of a sewing needle (not shown) and the RPM of the sewing machine. Detection signals from the detector 4 are delivered to a control unit 5. A switch-operated input unit 6 serves as an input means enabling the operator to issue sewing machine operation commands, and includes, as shown in FIG. 2, an on-off switch a ganged with a treadle (not shown), and other switches b, c such as, for example, an emergency stop switch. The control unit 5 is responsive to command signals from the switch-operated input unit 6, signals from the detector 4, and other signals for controlling energization, de-energization, and the RPM of the motor 2, and also various modes of operation of the sewing machine 1.

A speech recognition unit 7, such as that disclosed in the Japenese Publication, *Electronic Science,* September, 1980, said publication herein incorporated by reference serves to recognize speech which is composed of a single character or a few characters voiced by the operator and received by a microphone 8, and supplies the control unit 5 with predetermined signals in response to the recognized speech. A speech synthesizer 9 is responsive to a control signal from the control unit 5 for producing a predetermined audio signal. An amplifier 11 amplifies the audio signal generated by the speech synthesizer 9 and drives a loudspeaker 10, which converts the audio signal into an audible form that can be recognized by the operator.

The control unit 5 is composed primarily of a microcomputer 12 receptive of output speech recognition signals from the speech recognition unit 7 and the command signals from the switch-operated input unit 6. The microcomputer 12 is also supplied with signals from the detector 4 which are indicative of the upper and lower sewing needle positions and with signals issued directly from the sewing machine which are representative of the current status of various parts of the sewing machine 1.

The microcomputer 12 is responsive to the upper and lower needle position signals as supplied from the detector 4 and the current status signals as supplied from the sewing machine 1 for determining the status of operation of the various parts of the sewing machine 1 and delivering to the speech synthesizer 9 signals indicative of a procedure necessary to perform successive sewing steps according to a program stored in the microcomputer 12.

The microcomputer 12 is also capable of detecting whether the sewing machine 1 is operating properly or not on the basis of a predetermined decision standard stored in the microcomputer 12. When any abnormal operation is detected, the microcomputer 12 generates an abnormal operation signal enabling the speech synthesizer 9 to produce a simulated voiced output predetermined for such an abnormal operation. The microcomputer 12 is supplied with a signal indicating the RPM of the sewing machine 1 from the detector 4 for controlling the motor 2 to operate so as to achieve the desired state of operation of the sewing machine 1. The speech synthesizer 9 serves to synthesize audio signals in response to the abnormal operation signal and the sewing procedure signal, and feeds synthesized audio signals to the amplifier 11.

A speed control unit 13 is supplied with a variable-speed operation command signal and a stop command signal from the microcomputer 12. The speed control unit 13 drives the motor 2 at a desired speed of rotation or de-energizes the motor 2 by switching (turning on or off) transistors 16, 17, which control energization and de-enerzation of a brake coil 14 of an electromagnetic brake contained in the motor 2 and a clutch coil 15 of an electromagnetic clutch contained in the motor 2, respectively. A solenoid 18 is controlled (energized and de-energized) by the conducting and nonconducting states of a transistor 19 under the control of the microcomputer 12 for driving or deactivating a thread cutting machanism (not shown) mounted in the sewing machine 1.

The sewing machine control system of the foregoing construction will operate as follows:

The speech recognition unit 7 is arranged so as to be able to recognize three monosyllables "a", "b" and "c." The speech recognition unit 7 supplies the microcomputer 12 with a signal indicative of a command for starting the sewing machine 1 in response to the recognition of the sound "a", and with a signal indicative of a command for stopping the sewing machine when the sewing needle is in its lower position in response to the recognition of the sound "b." A signal indicative of a command to cut off the thread and stop the sewing machine when the sewing needle is in its upper position is provided in response to the recognition of the sound "c."

When the operator effects a predetermined initial action on the sewing machine 1 to start a desired sewing operation, the sewing machine 1 delivers a status signal indicative of such initial action to the microcomputer 12. In response to such a status signal, the microcomputer 12 operates according to the stored program to generate a signal indicative of the next step necessary for starting the sewing operation, such as "stitch setting," and supplies such a signal to the speech synthesizer 9. The speech synthesizer 9 is responsive to the supplied signal for producing an audio signal representing "Make a stitch setting," which is then fed to the amplifier 11. The loudspeaker 10 now produces, in a simulated voice, the words "Make a stitch setting" which can be recognized by the operator.

When the operator then takes such action on the sewing machine 1 according to the voiced command, the microcomputer 12 detects this action based on another status signal newly supplied from the sewing machine 1, and thereafter enables speech synthesizer 9, the amplifier 11, and the loudspeaker 10 to produce voiced speech commanding the next necessary step, if any.

At the step at which the motor 2 can be started, the operator utters the sound "a," which is fed through the microphone 8 to the speech recognition unit 7, whereupon the latter recognizes the sound "a." The speech recognition unit 7 now sends a signal commanding the starting of operation of the sewing machine to the microcomputer 12, which in response thereto supplies a variable-speed operation command signal to the speed control unit 13. The speed control unit 13 is responsive to the supplied signal for turning the transistors 16, 17 on and off to actuate the electromagnetic brake and clutch (not shown) contained in the motor 2 to control the latter to rotate at a predetermined speed. The sewing machine 1 and the detector 4 then supply the microcomputer 12 with signals indicative of upper and lower sewing needle positions and the RPM of the sewing machine, and the microcomputer 12 controls the operation of the motor 2 according to the supplied signals to drive the sewing machine.

While the sewing machine is being thus operated, if the operator utters the sound "b," which is recognized by the speech recognition unit 7, it then produces the signal commanding the stoppage of the sewing needle at the lower sewing needle position. In response to this command signal, the microcomputer 12 decelerates the motor 2 and then stops the same upon detection of the sewing machine having reached the lower position based on a signal from the detector 4. On the other hand, when the operator voices the sound "c" and the speech recognition unit 7 recognizes this sound while the sewing machine 1 is in operation, the speech recognition unit 7 generates signals commanding thread cutting and stoppage of the sewing machine 1 at the upper sewing needle position. The microcomputer 12 responds to these signals to decelerate the motor 2 down to a predetermined thread cutting speed and energizes the solenoid 18 to actuate the thread cutting mechanism. Upon reception of an upper sewing needle position signal from the detector 4, the microcomputer 12 returns the thread cutting mechanism and stops the motor 2 to stop the sewing machine at the upper sewing needle position. When the operator utters the sound "c" to enable the speech recognition unit 7 to generate the signals commanding thread breakage and stoppage of the sewing machine 1 at the upper sewing needle position while the sewing machine 1 is stopped at the lower sewing needle position, the microcomputer 12 energizes the solenoid 18 for the thread cutting mechanism and simultaneously rotates the motor 2 to drive the sewing machine at the predetermined thread cutting speed. Thereafter, the microcomputer 12 is responsive to the upper sewing needle position signal from the detector 4 to de-energize the solenoid 18 and stop the motor 2.

When a signal from the detector 4 fails to be supplied to the microcomputer 12 for some reason, the microcomputer 12 detects such malfunction of the sewing machine 1 based on a predetermined decision standard, and issues to the speech synthesizer 9 a control signal enabling the latter to generate a signal indicative of a predetermined simulated voice such as the words "The detector is malfunctioning" or the like. The signal produced by the speech synthesizer 9 is fed through the amplifier 11 to the loudspeaker 10, which then voices the simulated sound.

When any malfunction of the sewing machine 1 is directly detected by the microcomputer 12, the latter supplies the speech synthesizer 9 with a signal enabling the latter to create a predetermined audio signal indicative of such malfunction. The output audio signal from the speech synthesizer 9 is then amplified by the amplifier 11 and emitted from the loudspeaker 10 so that the operator is informed of the occurrence of the malfunction. A variety of different sewing machine malfunctions can be voiced by designing the speech synthesizer 9 so as to be able to generate as many simulated speech sounds.

The sounds which the speech recognition unit 7 can recognize are in no way limited to the above described examples. The speech recognition unit 7 can be arranged such that it can recognize many more single sounds or combined single sounds or words for producing signals indicative of an increased number of different operation commands.

The control unit 5 may be made capable of determining whether actions performed by the operator on the sewing machine 1 are proper of not, and the result of such a determination may be announced in the form of a voiced sound through the speech synthesizer 9, the amplifier 11, and the loudspeaker 10. Information regarding the current operational state of the sewing machine 1 can also be announced by speech through a simple change in the design of the control system.

While in the illustrated embodiment the control system has only a loudspeaker for speech announcement, other display means such as a light-emitting diode display, for example, may be added for concurrent or separate indication of the operator's actions on the sewing machine and any malfunctions of the latter.

With the arrangement of the present invention, the sewing machine control system can supply predetermined operation commands on the basis of predetermined voiced sounds instead of control switches. The number of control switches can thus remain a minimum regardless of an increased number of modes of operation of the sewing machine. Accordingly, the input unit is relatively compact and easy to operate and handle.

Although a certain preferred embodiment has been shown and described, it should be understood that many changes and modifications may be made therein without departing from the scope of the appended claims.

What is claimed is:

1. A system for controlling a sewing machine, comprising;

drive means for driving the sewing machine;

brake means for stopping the sewing machine;

detection means for detecting operational states of the sewing machine;

input means for supplying operation commands to the sewing machine;

control means for controlling said drive means and said brake means in response to a command signal from said input means and a detection signal from said detection means;

said input means including speech input means having a speech recognition unit responsive to predetermined voiced inputs for supplying predetermined signals indicative of said operation commands to said control means; and said control means being responsive to said operation command signals from said speech input means to supply predetermined control command signals to said drive means and said brake means.

2. A system according to claim 1, said drive means including a variable-speed motor having an electromagnetic clutch mechanism.

3. A system according to claim 1, said drive means including a variable-speed motor having an electromagnetic clutch mechanism, said brake means comprising an electromagnetic brake contained in said variable-speed motor.

4. A system according to claim 1, wherein said detecting means comprises means for detecting the position of a sewing needle of the sewing machine and for issuing signals indicative of said position.

5. A system according to claim 1, wherein said detection means comprises means for detecting the speed of rotation of the sewing machine and issuing a signal indicative of said speed of rotation.

6. A system according to claim 1, wherein said input means further comprises switch-operated input means including control switches.

7. A system according to claim 6, wherein said speech input means includes a microphone for feeding voiced inputs to said speech recognition unit.

8. A system according to claim 6, wherein one of said control switches comprises an on-off switch actuatable in response to movement of a treadle of the sewing machine.

9. A system for controlling a sewing machine, comprising;

drive means for driving the sewing machine;

brake means for stopping the sewing machine;

detection means for detecting operational states of the sewing machine;

input means for supplying operation commands to the sewing machine;

control means for controlling said drive means and said brake means in response to a command signal from said input means and a detection signal from said detection means;

said input means including speech input means having a speech recognition unit responsive to predetermined voiced inputs for supplying predetermined signals indicative of said operation commands to said control means, and a switch-operated input means; and said control means including a microcomputer for processing said operation command signals from said speech input means, operation command signals from said switch-operated input means, and signals indicative of the operational states of the sewing machine from said detection means.

10. A system according to claim 9, said drive means including a variable-speed motor having an electromagnetic clutch mechanism.

11. A system according to claim 9, said drive means including a variable-speed motor having an electromagnetic clutch mechanism, said brake means comprising an electromagnetic brake contained in said variable-speed motor.

12. A system according to claim 9, wherein said detecting means comprises means for detecting the position of a sewing needle of the sewing machine and for issuing signals indicative of said position.

13. A system according to claim 9, wherein said detection means comprises means for detecting the speed of rotation of the sewing machine and issuing a signal indicative of said speed of rotation.

14. A system according to claim 9, wherein said switch-operated input means comprises a plurality of control switches including an on-off switch actuatable in response to movement of a treadle of the sewing machine.

* * * * *